US009174817B2

(12) United States Patent
Maruta et al.

(10) Patent No.: US 9,174,817 B2
(45) Date of Patent: Nov. 3, 2015

(54) SHEET CONVEYING DEVICE AND IMAGE FORMING APPARATUS INCORPORATING SAME

(71) Applicants: Kazuya Maruta, Tokyo (JP); Kohsuke Yoshida, Kanagawa (JP)

(72) Inventors: Kazuya Maruta, Tokyo (JP); Kohsuke Yoshida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/478,389

(22) Filed: Sep. 5, 2014

(65) Prior Publication Data

US 2015/0071692 A1 Mar. 12, 2015

(30) Foreign Application Priority Data

Sep. 9, 2013 (JP) ..... 2013-186390
Feb. 17, 2014 (JP) ..... 2014-027633

(51) Int. Cl.
*B65H 9/04* (2006.01)
*B65H 9/06* (2006.01)
*B65H 9/00* (2006.01)
(Continued)

(52) U.S. Cl.
CPC ..... *B65H 9/002* (2013.01); *B65H 3/0669* (2013.01); *B65H 5/068* (2013.01); *B65H 7/02* (2013.01); *B65H 7/06* (2013.01); *B65H 7/12* (2013.01); *B65H 9/008* (2013.01); *B65H 9/06* (2013.01); *G03G 15/6529* (2013.01); *B65H 2511/13* (2013.01); *B65H 2511/212* (2013.01)

(58) Field of Classification Search
CPC ..... B65H 9/002; B65H 9/004; B65H 9/006; B65H 7/08; B65H 2404/721; B65H 2404/722; B65H 2404/7231; B65H 9/04; B65H 2301/331; B65H 2511/242; B65H 9/06; B65H 2404/1381; B65H 2404/14212; G03G 15/6558; G03G 15/6567; G03G 2215/00405
See application file for complete search history.

(56) References Cited

U.S. PATENT DOCUMENTS 6,011,948 A 1/2000 Amano et al.
2005/0035536 A1* 2/2005 Suga et al. ..... 271/226
(Continued)

FOREIGN PATENT DOCUMENTS

EP 0782967 A1 7/1997
EP 2399852 A2 12/2011
(Continued)

OTHER PUBLICATIONS

Extended European Search Report dated Feb. 6, 2015 issued in corresponding European Application No. 14183802.9.

*Primary Examiner* — Daniel J Colilla
*Assistant Examiner* — Ruben Parco, Jr.
(74) *Attorney, Agent, or Firm* — Harness, Dickey & Pierce, P.L.C.

(57) ABSTRACT

A sheet conveying device, which is incorporated in an image forming apparatus, includes a sheet holding and conveying roller pair having two rollers to convey a sheet while holding the sheet between the two rollers at a nip where the two rollers contact each other, and a gate member disposed movable with rotation of the sheet holding and conveying roller pair to correct skew of the sheet in a sheet conveying direction when a leading end of the sheet in the sheet conveying direction abuts against the gate member. The gate member has a contact surface against which the sheet abuts. The contact surface of the gate member is disposed upstream from the nip of the sheet holding and conveying roller pair in the sheet conveying direction. A setting position of the contact surface is adjusted according to thickness of the sheet.

10 Claims, 12 Drawing Sheets

(51) Int. Cl.

| | |
|---|---|
| ***B65H 7/02*** | (2006.01) |
| ***B65H 3/06*** | (2006.01) |
| ***B65H 5/06*** | (2006.01) |
| ***B65H 7/06*** | (2006.01) |
| ***B65H 7/12*** | (2006.01) |
| ***G03G 15/00*** | (2006.01) |

(56) References Cited

U.S. PATENT DOCUMENTS

| | | | | |
|---|---|---|---|---|
| 2007/0126176 | A1 | 6/2007 | Ha | |
| 2011/0316226 | A1 | 12/2011 | Karikusa et al. | |
| 2013/0241141 | A1 * | 9/2013 | Karikusa | 271/227 |

FOREIGN PATENT DOCUMENTS

| | | | | | |
|---|---|---|---|---|---|
| JP | 60082553 | A | * | 5/1985 | B65H 9/16 |
| JP | 6-191686 | | | 7/1994 | |
| JP | 7-089645 | | | 4/1995 | |
| JP | 07089646 | A | * | 4/1995 | B65H 9/16 |
| JP | 07309481 | A | * | 11/1995 | B65H 9/16 |
| JP | 2002-060097 | | | 2/2002 | |
| JP | 2006-248676 | | | 9/2006 | |
| JP | 2011-190026 | | | 9/2011 | |
| JP | 2012-030971 | | | 2/2012 | |
| JP | 2012-062194 | | | 3/2012 | |

* cited by examiner

SHEET CONVEYING DEVICE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2013-186390, filed on Sep. 9, 2013 and 2014-027633, filed on Feb. 17, 2014, in the Japan Patent Office, the entire disclosures of which are hereby incorporated by reference herein.

BACKGROUND

1. Technical Field

This disclosure relates to a sheet conveying device that conveys sheet such as paper and an image forming apparatus that incorporates the sheet conveying device.

2. Related Art

Image forming apparatus includes copier, printer, facsimile machine, plotter, and multifunctional apparatus including at least two functions of the copier, the printer, the facsimile machine, and the plotter. Such image forming apparatus is currently demanded on the market to perform a paper handling operation of a wide variety of sheets of paper different in type, thickness, size, and the like. Specifically, printers are expected to be faster while handling the above-described variety of sheets of paper. Moreover, there is an increasing demand of the market for image position accuracy.

At present, as a paper position correcting mechanism for enhancing the image position accuracy, a known skew correcting mechanism corrects skew in which a sheet is conveyed while diagonally displaced with respect to a sheet conveying direction.

Another known shift mechanism corrects positions of an image and paper in a sheet width direction (a main scanning direction) orthogonal to the sheet conveying direction.

One method of the skew correcting mechanism is a nip method in which a nip is formed by forming one of a registration roller pair as a rubber roller and the other as a metal roller and diagonal displacement is corrected by abutting a leading end of paper against the nip.

An example of the skew correcting mechanism discloses a method in which a drive roller of each of registration roller pair and each of gate members, against which a leading end of paper abuts, are formed integrally.

In this method, after abutting the leading end of the paper against the gate members to correct the diagonal displacement, the rollers of the registration roller pair are rotated to convey the paper and the gate members are rotated in synchronization with rotation of the registration roller pair to move aside from a sheet conveying path.

The gate members with respect to a subsequent sheet can be repositioned in a short time by a single turn of the registration roller pair. Therefore, skew correction (diagonal displacement correction) of the sheets conveyed at high speed can be performed and intervals between the conveyed sheets can be reduced.

Furthermore, each of the gate members has a sheet conveying guide portion. When the sheet is convened to a conveyance roller pair disposed downstream from the registration roller pair in the sheet conveying direction, a driven roller of the registration roller pair separates form a drive roller thereof.

After a trailing end of the sheet passes between the two rollers of the registration roller pair, the driven roller comes into contact with the drive roller again.

By employing a method in which the two rollers of the registration roller pair contact with pressure, are rotated, and the gate member is repositioned, high-speed skew correction can be performed irrespective of length of the sheet.

In a shift mechanism, a sensor that detects an end of the sheet is provided to the sheet conveying path, so that a positional displacement of the sheet and an image from each other is calculated. Based on detection results obtained by the calculation, a skew correcting mechanism is moved in the main scanning direction to align the image.

SUMMARY

At least one aspect of this disclosure provides a sheet conveying device including a sheet holding and conveying roller pair having two rollers to convey a sheet while holding the sheet between the two rollers at a nip where the two rollers contact each other, and a gate member disposed in a vicinity of the sheet holding and conveying roller pair and movable with rotation of the sheet holding and conveying roller pair to correct skew of the sheet in a sheet conveying direction when a leading end of the sheet in the sheet conveying direction abuts against the gate member. The gate member has a contact surface against which the sheet abuts. The contact surface of the gate member is disposed upstream from the nip of the sheet holding and conveying roller pair in the sheet conveying direction. A setting position of the contact surface is adjusted according to thickness of the sheet.

Further, at least one example of this disclosure provides an image forming apparatus including an image carrier on which an electrostatic latent image is formed based on image data, a developing device to develop the electrostatic latent image into a visible toner image, the sheet conveying device according to claim 1 to transfer the visible toner image onto a recording medium, and a fixing device to fix the visible toner image to the recording medium.

BRIEF DESCRIPTION OF THE DRAWINGS

A more complete appreciation of the disclosure and many of the advantages thereof will be obtained as the same becomes better understood by reference to the following detailed description when considered in connection with the accompanying drawings, wherein.

DETAILED DESCRIPTION

Figure 1:
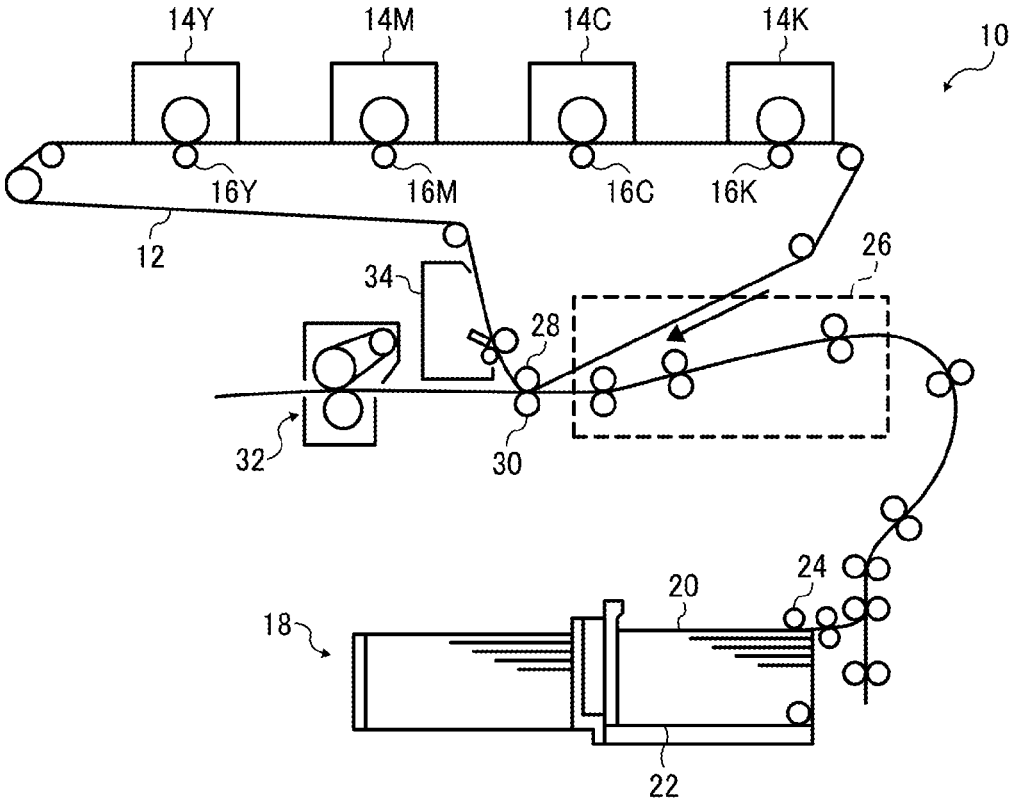
FIG. 1 is a diagram illustrating a schematic configuration of an image forming apparatus according to an example of the disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 10 according to an example of the disclosure with reference to FIGS. 1 through 12B.

The image forming apparatus 10 may be a copier, a facsimile machine, a printer, a plotter, a multifunction peripheral or a multifunction printer (MFP) having at least one of copying, printing, scanning, facsimile, and plotter functions, or the like. According to the present example, the image forming apparatus 10 is an electrophotographic printer that forms color and monochrome toner images on a sheet or sheets by electrophotography.

More specifically, the image forming apparatus 10 functions as a color printer. However, the image forming apparatus 10 can expand its function as a copier by adding a scanner as an option disposed on top of an apparatus body of the image forming apparatus 10. The image forming apparatus 10 can further obtain functions as a facsimile machine by adding an optional facsimile substrate in the apparatus body of the image forming apparatus 10.

Further, it is to be noted in the following examples that the term "sheet" is not limited to indicate a paper material but also includes OHP (overhead projector) transparencies, OHP film sheets, coated sheet, thick paper such as post card, thread, fiber, fabric, leather, metal, plastic, glass, wood, and/or ceramic by attracting developer or ink thereto, and is used as a general term of a recorded medium, recording medium, recording sheet, and recording material to which the developer or ink is attracted.

As illustrated in FIG. 1, the image forming apparatus 10 includes an intermediate transfer belt 12 and process cartridges 14Y, 14M, 14C, and 14K.

The intermediate transfer belt 12 functions as an intermediate transfer body and is supported on a plurality of rollers and in a shape of an endless belt.

The and process cartridges 14Y, 14M, 14C, and 14K function as image forming devices disposed along a horizontal plane of the intermediate transfer belt 12.

The suffix Y represents yellow, M represents magenta, C represents cyan, and K represents black, respectively.

Toner images as visible images formed by the respective process cartridges 14Y, 14M, 14C, and 14K are superimposed and transferred onto a surface of the intermediate transfer belt 12 in order by primary transfer rollers 16Y, 16M, 16C, and 16K as primary transfer units.

A feed unit 18 is disposed at a lower portion of an apparatus body of the image forming apparatus 10.

The feed unit 18 includes a feed tray 22 and a feed roller 24.

The feed tray 22 accommodates sheets of paper 20 (hereinafter, also referred to as a sheet 20) as sheet-shaped recording media in a layered state.

The feed roller 24 separates and feeds the uppermost sheet of paper one by one, and the like.

The sheet 20 is conveyed by multiple sheet conveying roller pairs and entered into a sheet conveying device 26, corrected for a diagonal displacement with respect to a sheet conveying direction and a displacement in a sheet width direction (in a main scanning direction) orthogonal to the sheet conveying direction in the sheet conveying device 26, and conveyed to a secondary transfer part at a given timing.

In the secondary transfer part, secondary transfer rollers 30 as secondary transfer devices contact secondary transfer opposed rollers 28 which are rollers supporting the intermediate transfer belt 12 with the intermediate transfer belt 12 interposed between the secondary transfer opposed rollers 28 and the secondary transfer rollers 30.

The above-described given timing refers to the time when a given position of the sheet 20 conveyed by the sheet conveying device 26 and the composite toner image on the intermediate transfer belt 12 are aligned with each other.

The sheet 20 having the composite toner image thereon enters a fixing unit 32 where the composite toner image is fixed to the sheet 20 by application of heat and pressure.

The sheet 20 after the fixing is discharged to a discharge tray.

The surface of the intermediate transfer belt 12 after the secondary transfer is cleaned by a belt cleaning unit 34.

The respective process cartridges 14Y, 14M, 14C, and 14K have the same configurations except colors of toner contained in the process cartridges 14Y, 14M, 14C, and 14K. Hereinafter, the process cartridges 14Y, 14M, 14C, and 14K are occasionally referred to in a singular form, for example, the process cartridge 14.

Figure 2:
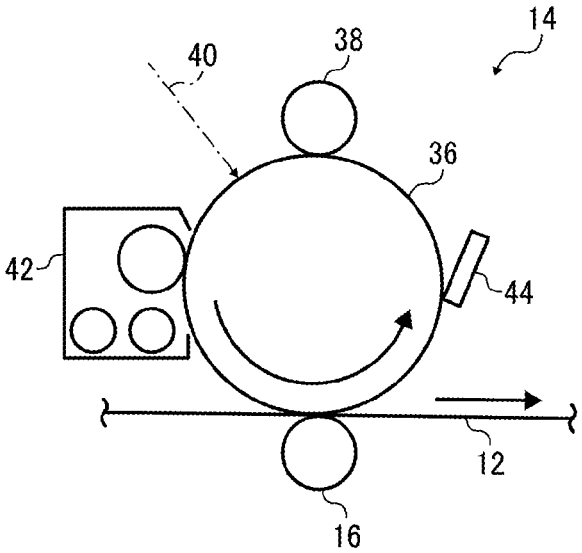
FIG. 2 is an enlarged view illustrating part of a process cartridge included in the image forming apparatus of FIG. 1.

In other words, as shown in FIG. 2, the process cartridge 14 includes a photoconductor drum 36 as an image carrier, a charging roller 38 as a charger to uniformly charge a surface of the photoconductor drum 36, a developing device 42 to develop an electrostatic latent image formed by exposure light 40 emitted from an exposure device into a visible toner image based on image data, a photoconductor cleaning unit 44 to clean the surface of the photoconductor drum 36 after completion of the primary transfer, an electric discharger, and the like.

Figure 3:
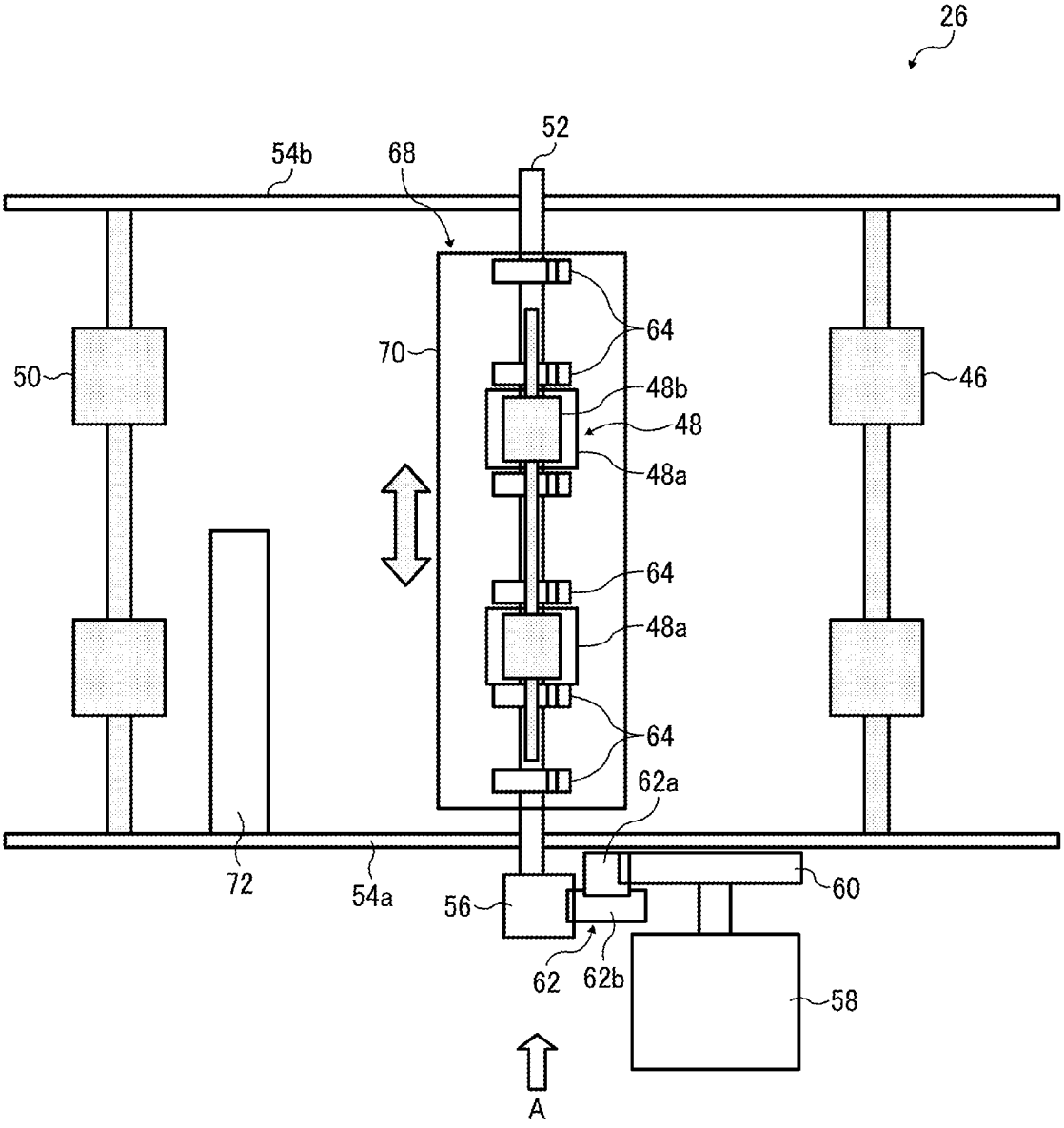
FIG. 3 is a plan view illustrating a sheet conveying device included in the image forming apparatus of FIG. 1.
Figure 4:
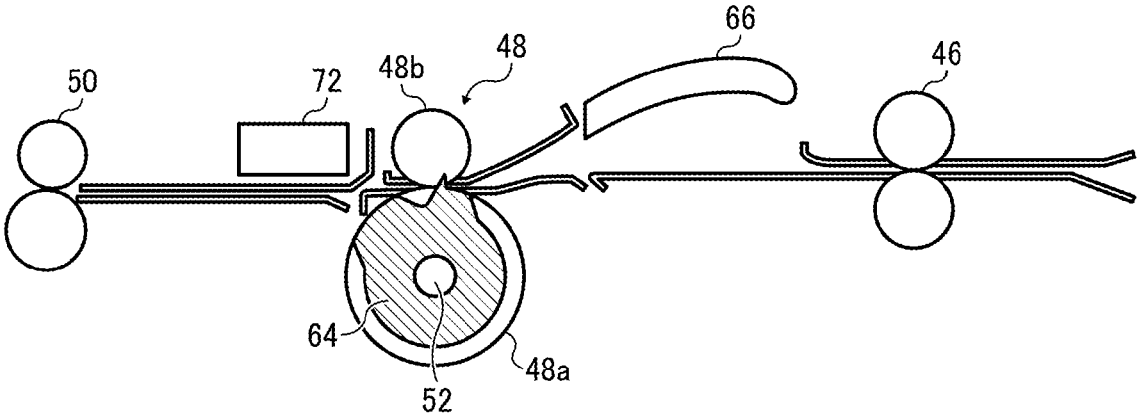
FIG. 4 is a cross-sectional view illustrating the sheet conveying device of FIG. 3, viewed along a direction A of FIG. 3.

Now, a description is given of a configuration of the sheet conveying device according to the present example with respect to FIGS. 3 and 4.

The sheet conveying device 26 includes a feed roller pair 46, a registration roller pair 48 as a sheet holding and conveying roller pair, a conveying roller pair 50, and the like in order from an upstream side along the sheet conveying direction.

The registration roller pair 48 includes a metal drive roller 48*a* and a rubber driven roller 48*b* that contacts the drive roller 48*a* to form a nip.

As shown in FIG. 3, a rotary shaft 52 of the drive roller 48*a* is rotatably supported between side plates 54*a* and 54*b* and movable in the sheet width direction. A small gear 56 is attached to one end of the rotary shaft 52. A large gear 60 is attached to a rotary shaft of a stepping motor 58 as a drive source to rotate the drive roller 48*a*. The large gear 60 is meshed with a small-diameter member 62*a* of a multi-stage gear 62.

The small gear 56 is meshed with a large-diameter member 62*b* of the multi-stage gear 62 and a rotational force (a driving force) of the stepping motor 58 is transmitted to the drive roller 48*a* via a gear train including the small gear 56, the large gear 60, and the multi-stage gear 62.

Gate members 64 are rotatably (operably) attached to the rotary shaft 52 in synchronization with the drive roller 48*a*. The gate members 64 are disposed at six positions, i.e, in the vicinity of both ends of the rotary shaft 52 and both ends of the drive roller 48*a* in an axial direction.

Figure 5:
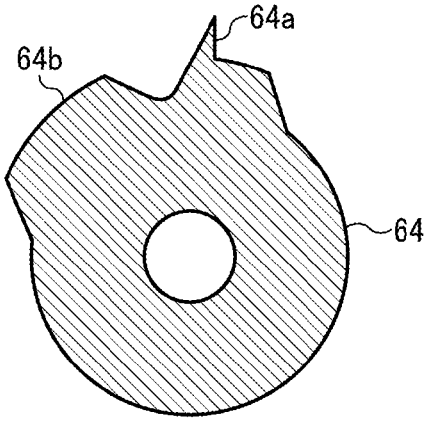
FIG. 5 is a side view illustrating a gate member included in the sheet conveying device of FIG. 3.

As illustrated in FIG. 5, each of the gate members 64 has a contact surface 64*a* against which a leading end of the sheet 20 in the conveying direction abuts and an arc-shaped conveyance guide plate 64*b* to smoothly convey the sheet 20 when the registration roller pair 48 is stopped.

In other words, the conveyance guide plate 64*b* has a shape corresponding to a part of an outer circumferential surface of the drive roller 48*a*.

Figure 6:
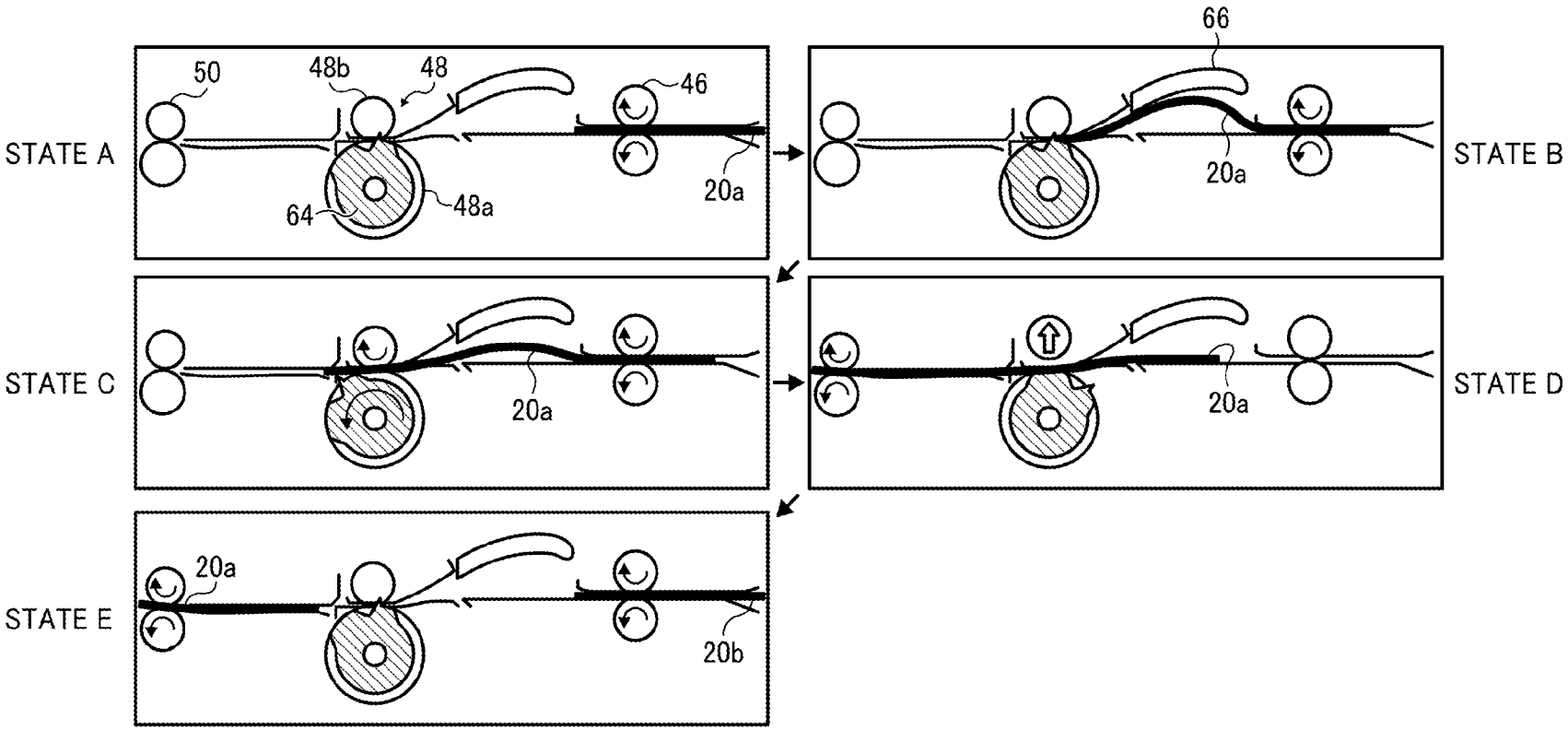
FIG. 6 is a diagram illustrating a state transition (states A through E) in a process of skew correction of the sheet conveying device according to an embodiment.

Now, a description is given of skew correcting operation by the sheet conveying device 26 with reference to states A through E of FIG. 6.

As illustrated in state A of FIG. 6, a sheet 20*a* is conveyed by the feed roller pair 46 in a state in which the contact surface 64*a* of each of the gate members 64 is standing substantially vertically and the registration roller pair 48 is stopped.

As illustrated in state B of FIG. 6, the sheet 20*a* is fed (excessively fed) by the feed roller pair 46 in a manner to form a warp in a state in which a leading end of the sheet 20*a* is in contact with the contact surface 64*a*.

A restricting guide 66 is disposed on an upper side of where the warp is formed to restrict the warp to a certain degree and secure a function of aligning the leading end of the sheet 20*a* is provided.

Due to resilience of the warp, the leading end of the sheet 20*a* uniformly contacts the contact surface 64*a* of each of the gate members 64. By so doing, contact displacement of the leading end of the paper in the sheet width direction is eliminated and the diagonal displacement caused on the upstream side is corrected.

When the diagonal displacement is corrected, as shown in state C of FIG. 6, the registration roller pair 48 rotate and the leading end of the sheet 20*a* is held by the nips and conveyed. At the same time, the contact surface 64*a* of each of the gate members 64 moves aside from the conveyance path.

At the timing when the leading end of the sheet 20*a* is held by the conveying roller pair 50 disposed downstream from the registration roller pair 48 in the sheet conveying direction, the registration roller pair 48 are stopped and the driven roller 48*b* separates from the drive roller 48*a* (state D of FIG. 6).

At this time, the conveyance guide plates 64*b* of the gate members 64 are positioned in the conveyance path and the conveying roller pair 50 is further conveyed.

After a trailing end of the sheet 20 passes through the registration roller pair 48, as shown in state E of FIG. 6, the gate members 64 are repositioned in order to receive a subsequent sheet 20*b* and the driven roller 48*b* contacts the drive roller 48*a*.

A single turn of the drive roller 48*a* of each of the registration roller pair 48 completes setting of a position of the contact surface 64*a* of each of the gate members 64 with respect to the subsequent sheet 20*b* from the previous skew correction.

For separating the driven roller 48*b*, any method of separating the driven roller 48*b* can be employed. For example, the drive roller 48*a* may be provided with a cam to separate the driven roller 48*b* or separate drive motor and cam may be used to separate the driven roller 48*b*.

Figure 7:
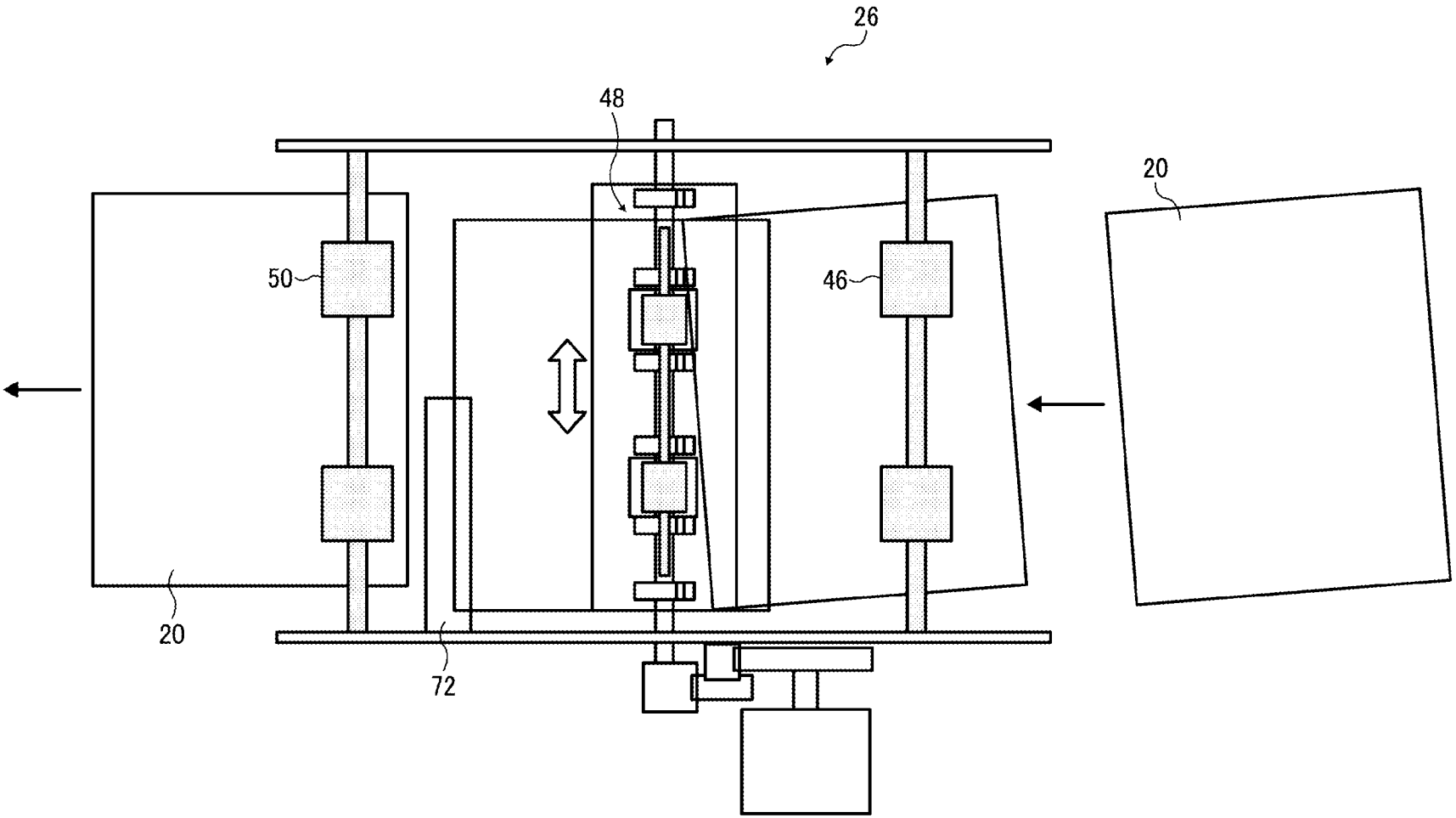
FIG. 7 is a plan view illustrating the sheet conveying device in skew correction and lateral displacement correction.

With this configuration, as shown in FIG. 7, the skew of the sheet 20 that has been displaced diagonally can corrected at high speed and the sheet 20 can be conveyed to the secondary transfer part in a state without the diagonal displacement. In FIG. 7, a wide white arrow indicates the sheet width direction and thin arrows indicate the sheet conveying direction.

As illustrated in FIG. 3, the sheet conveying device 26 in this example includes a shift mechanism 68 for correcting a positional displacement in the sheet width direction (the main scanning direction).

The shift mechanism 68 includes a shift unit 70 and a sheet sensor 72. The shift unit 70 integrally supports the registration roller pair 48, the gate members 64, the rotary shaft 52, and the small gear 56. The sheet sensor 72 functions as a sheet position detector to detect a position of the sheet 20 in the sheet width direction.

The sheet sensor 72 is formed by a CIS (contact image sensor) and supported by the side plate 54*a* between the registration roller pair 48 and the conveying roller pair 50.

Figure 13:
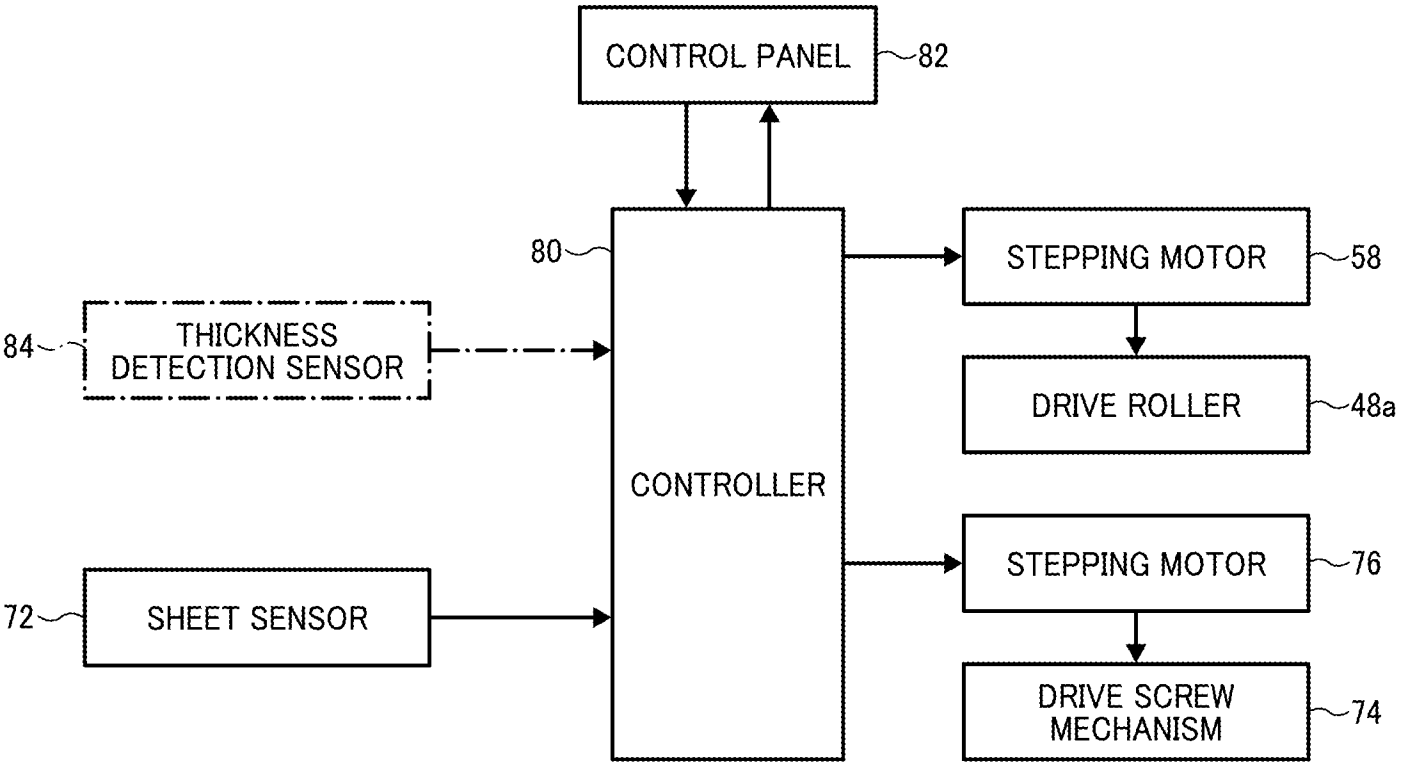
FIG. 13 is a block diagram illustrating a controller of the image forming apparatus of FIG. 1.

As shown in FIG. 13, the shift unit 70 has a drive screw mechanism 74 and a stepping motor 76 functioning as a drive source, for example.

If a position of the sheet 20 after the skew correction is found to be displaced in the sheet width direction based on detection results obtained by the sheet sensor 72, a position in the sheet width direction is adjusted before the leading end of the sheet 20 reaches the conveying roller pair 50.

A controller 80 determines a shift amount (the number of steps) based on the detection results obtained by the sheet sensor 72.

The shift mechanism 68 performs a position adjustment in the sheet width direction in a state in which the multi-stage gear 62 and the gear 56 are meshed with each other. Therefore, an axial width of the gear 56 is set to such a dimension that stable gear meshing is maintained even at a maximum adjustment amount.

As described above, in the sheet conveying device 26, the skew of the sheet 20 is corrected by abutting the leading end of the paper against the contact surfaces 64*a* of the gate members 64 and warping the sheet 20 instead of the nips of the registration roller pair 48.

Figure 8:
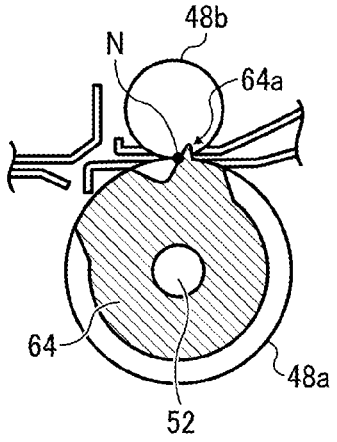
FIG. 8 is a diagram illustrating positional relation of the gate member and a contact surface of the gate member and a nip at a sheet aligning position.

Therefore, as shown in FIG. 8, positions of the contact surfaces 64*a* are on an upstream side of the nips N in the sheet conveying direction.

Then, the registration roller pair 48 integrally arranged with the gate members 64 are rotated to convey the sheet 20 to the nips N while causing the sheet 20 to follow movement of the gate members 64.

Figure 9A:
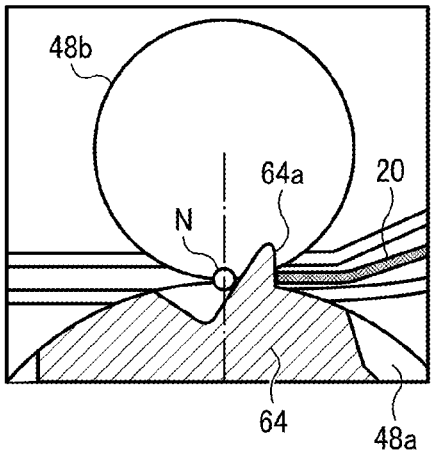
FIGS. 9A and 9B are diagrams illustrating a sheet conveying state between the sheet aligning position and the nip.
Figure 9B:
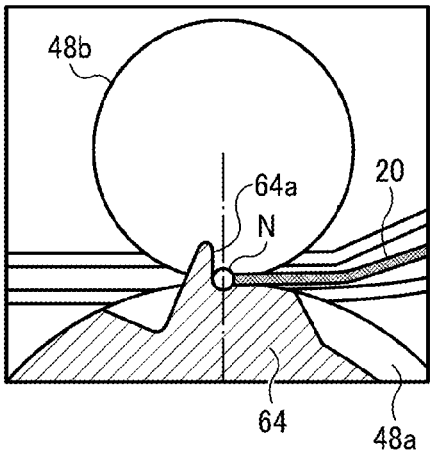

At this time, as illustrated in state B of FIG. 6, the paper is caused to follow the gate members 64 by using stiffness of the paper, which is generated when the sheet 20 is warped, and conveyed to the nip N. FIGS. 9A and 9B are diagrams illustrating sheet conveying states between the paper aligning position and the nip.

The stiffness of the sheet means a force of the sheet to return into a straight state when the sheet is warped.

Here, the nip means not a center of the nip but an upstream starting point of the nip, in a case in which the nip has a width in the sheet conveying direction.

In this example, the nip is illustrated as a point in the drawings.

In conveying the sheet 20 after the skew has been corrected by the gate members 64 to positions of the nips N, if positions of the contact surfaces 64*a* of the gate members 64 are close to the position of the nip, the sheet 20 is smoothly conveyed to the nip position, even if the stiffness of the sheet 20 is low.

However, if the contact surfaces 64*a* approaches the nip position, an inconvenience occurs in a case of conveying a thick paper.

Figure 10A:
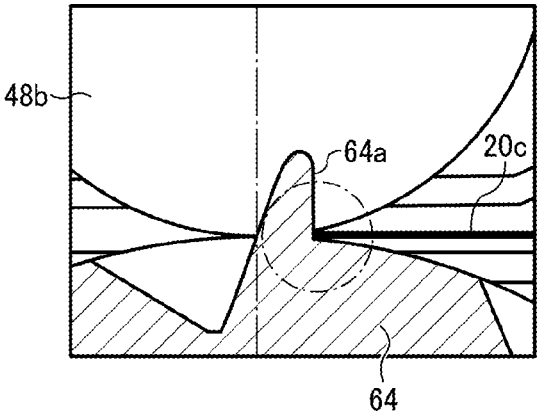
FIG. 10A is a diagram illustrating the gate member and a registration roller pair when a thin paper is conveyed to the sheet aligning position.

As shown in FIG. 10A, in a case of conveying a sheet 20*c* that is a thin paper, the sheet 20*c* is conveyed to and abuts against the contact surfaces 64*a*, so that the skew is corrected by the gate members 64.

Figure 10B:
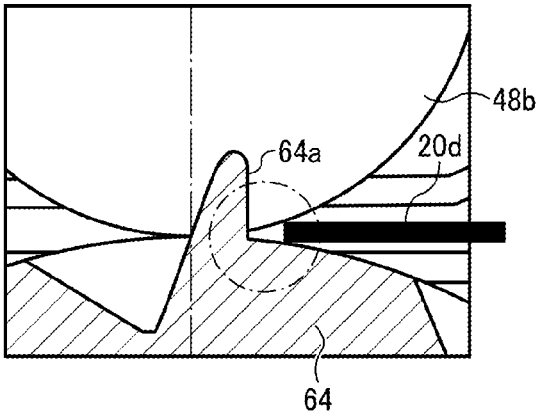
FIG. 10B is a diagram illustrating the gate member and the registration roller pair when a thick paper is conveyed to the sheet aligning position.

In a case of conveying a sheet 20*d* that is a thick paper, as illustrated in FIG. 10B, the sheet 20*d* abuts against the registration roller pair 48 before the sheet 20*d* reaches the contact surfaces 64*a* and therefore the skew is not corrected by the gate members 64, and therefore skew correction with high accuracy cannot be performed.

By contrast, if the contact surface 64*a* is positioned away from the nip in order to adapt to the thick paper (e.g., the sheet 20*d*), a distance to the nip positions is far from the leading end of the sheet when the registration roller pair 48 rotates after the skew correction, and therefore a conveyance attitude of the thin paper (e.g., the sheet 20*c*) having low stiffness is not stable.

Therefore, even though the skew correction has been performed, the sheet (e.g., the sheet 20*c*) is displaced on its way to the position of the nip, and therefore the skew correction with high accuracy cannot be performed.

Figure 11:
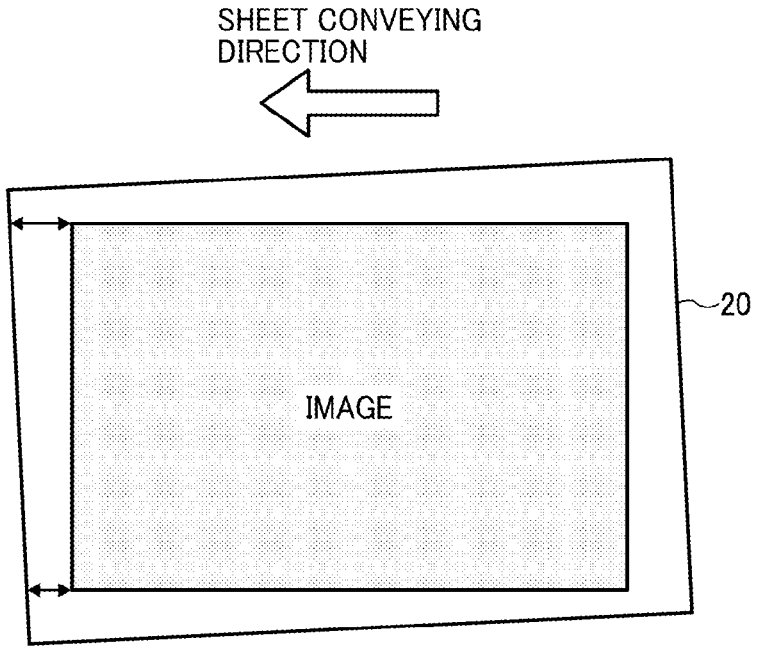
FIG. 11 is a plan view illustrating positional displacement of an image when the skew correction is not performed properly.

If the sheet 20 is conveyed to the secondary transfer part in a state in which the skew correction has not been performed with accuracy, a position of an image is displaced with respect to the sheet as shown in FIG. 11.

Figure 12A:
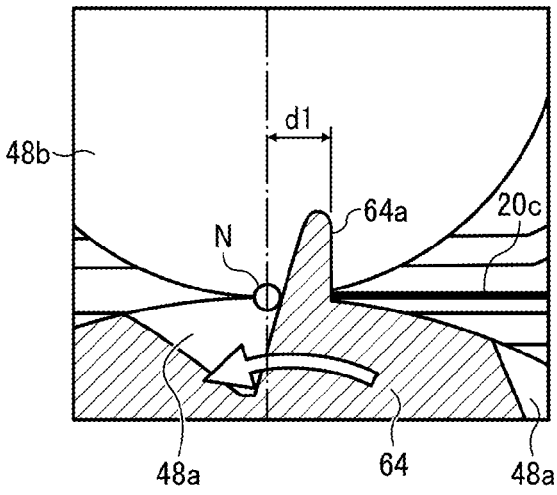
FIGS. 12A and 12B are diagrams illustrating adjustment of a setting position (the sheet aligning position) of the contact surface according to the sheet.
Figure 12B:
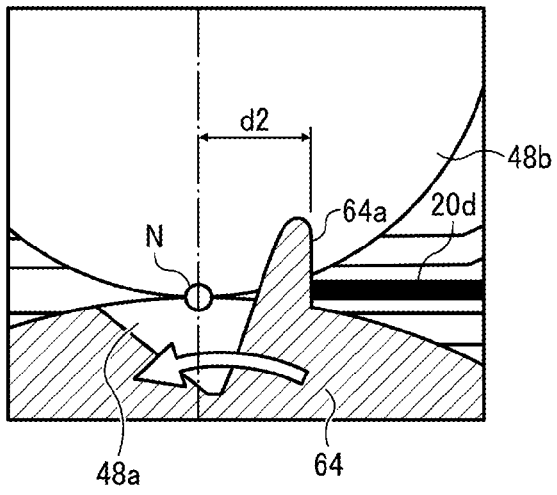

In order to address this inconvenience, in the example, as illustrated in FIGS. 12A and 12B, positions (paper aligning positions) of the contact surfaces 64*a* of the gate members 64 are changed according to thickness of sheet of paper.

In the case of conveying the thin paper 20*c* as a thin paper, as shown in FIG. 12A, rotation of the drive roller 48*a* is controlled so that the contact surfaces 64*a* are positioned close to the position of the nip.

In the case of conveying the sheet 20*d* as a thick paper, as shown in FIG. 12B, rotation of the drive roller 48*a* is controlled so that the contact surfaces 64*a* are positioned away from the position of the nip.

As illustrated in FIG. 13, the controller 80 performs the above-described adjustment.

If a user sets a thickness of paper (paper type) by using a control panel 82 as a thickness setting unit, the controller 80 adjusts setting positions (paper aligning positions) of the contact surfaces 64*a* of the gate members 64 according to the set thickness.

Specifically, the stepping motor 58 is controlled with the number of steps according to the thickness to adjust rotation of the drive roller 48*a*.

In the case of conveying the thin paper (e.g., the sheet 20*c*), as illustrated in FIG. 12A, rotation of the drive roller 48*a* is controlled so that the contact surface 64*a* is positioned at a distance d1 toward an upstream side from the nip N.

In the case of conveying the thick paper (e.g., the sheet 20*d*), as illustrated in FIG. 12B, rotation of the drive roller 48*a* is controlled so that the contact surface 64*a* is positioned at a distance d2 (d1<d2) toward the upstream side from the nip N.

Setting positions d1 and d2 are recorded information obtained in advance.

If a various types of paper with various thicknesses are used, a suitable distance d such as the distance d1 and the distance d2 from the nips for each of types and thicknesses of paper may be between the position of the nip and the leading end of the sheet, which is obtained in advance based on results of experiments and stored in memory of the controller 80 and the distance d may be adjusted by using table control.

Sheets of paper may be classified in terms of not thickness but stiffness of paper (paper type) and controlled.

Although conditions such as the thickness of the paper is set by using the control panel 82 in the example, a sheet thickness detector 84 to detect thickness of the sheet during conveyance may be provided on the upstream side of the registration roller pair 48 to automatically detect the thickness of the sheet.

The sheet thickness detector 84 may use a sensor for determining paper thickness based on a transmission amount of light of a light transmission type sensor, for example.

If the method in which the paper thickness is automatically detected by the sheet thickness detector 84 is employed, the trouble of setting by inputting the thickness by the user can be saved and incorrect input can be prevented.

In this example, the gate members 64 are formed as separate members from the drive roller 48*a* and fitted over and attached to the rotary shaft 52 integrally with the drive roller 48*a*. However, this disclosure is not limited thereto.

For example, if only the contact surfaces 64*a* of the gate members 64 positioned at side surfaces of the drive roller 48*a* are integrally molded with the side surfaces of the drive roller 48*a*, a similar function to the above-described configuration can be obtained.

Figure 14:
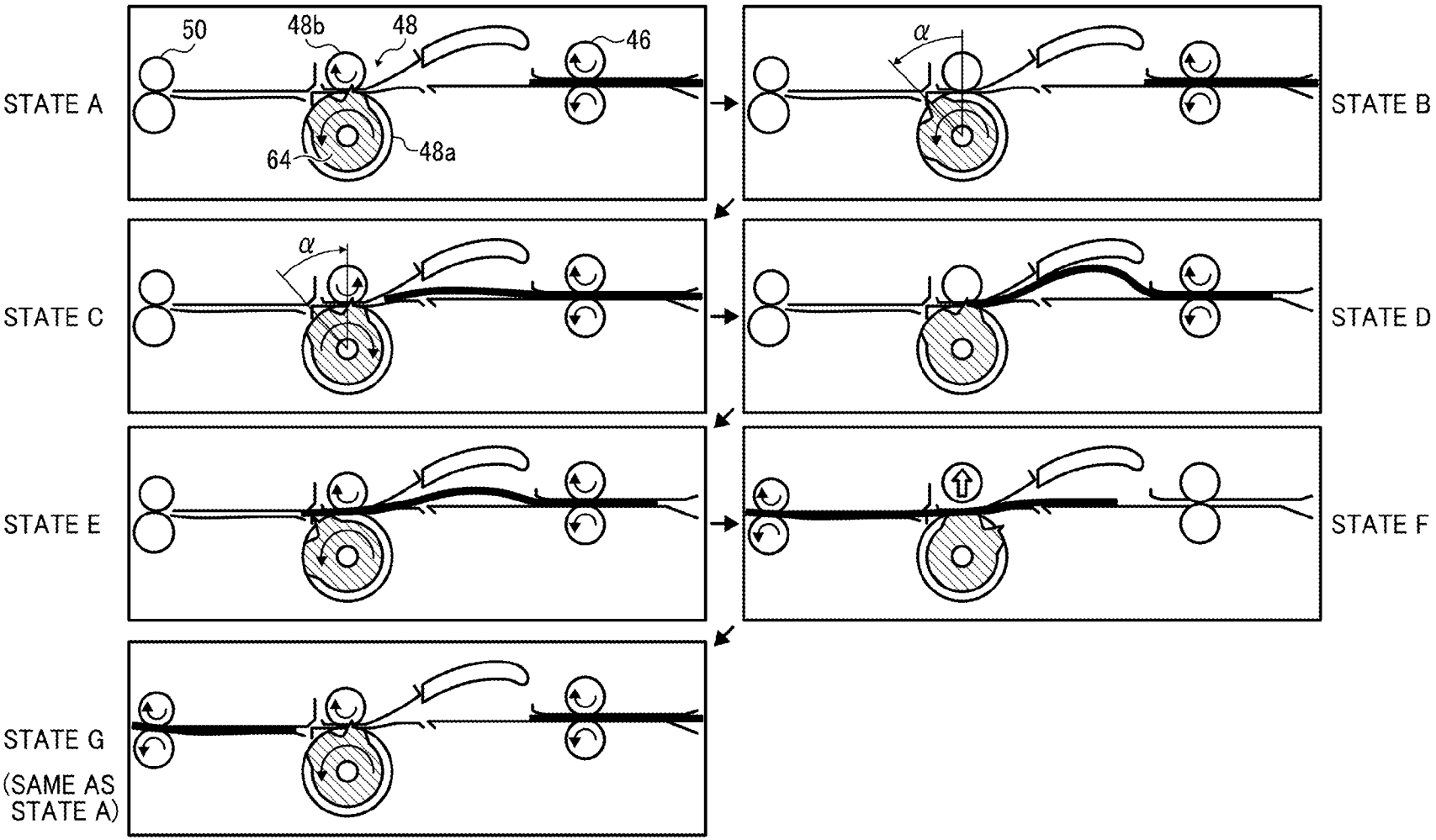
FIG. 14 is a diagram illustrating a state transition (states A through G) in a process of skew correction of a sheet conveying device according to another example of the disclosure.
Figure 15:
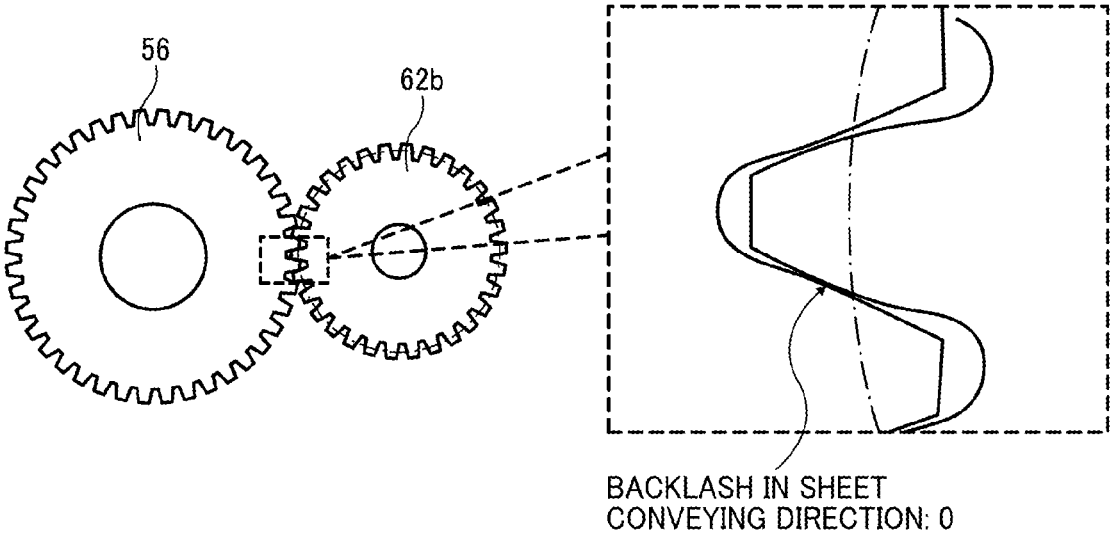
FIG. 15 is a diagram illustrating a state in which a backlash of a gear is eliminated.

Next, a description is given of a different configuration of the sheet conveying device 26 with respect to FIGS. 14 and 15 according to another example of this disclosure with reference to FIGS. 1 through 13.

The same portions as those in the above-described example will be shown with the same reference numerals. Only essential portions will be described by omitting structural and functional descriptions which have already been given unless otherwise necessary (the same shall apply to another example described later).

As described above, a rotational force of a stepping motor 58 functioning as a drive source is transmitted to drive roller 48*a* via the gear train including the small gear 56, the large gear 60, and the multi-stage gear 62. A gear has backlash and therefore there are variations in paper aligning positions of contact surfaces 64*a* of gate members 64 corresponding to the backlash.

In this example, in order to address this inconvenience, instead of positioning the contact surfaces 64*a* of the gate members 64 at paper aligning positions within a single turn of the drive roller 48*a*, the drive roller 48*a* is excessively rotated in the sheet conveying direction and then rotated reversely to remove backlash.

As illustrated in state B of FIG. 14, in rotating the registration roller pair 48 to position the contact surfaces 64*a* of the gate members 64 at the paper aligning positions, the registration roller pair 48 is rotated by an angle $\alpha$ ($\alpha°$) in the sheet conveying direction from the paper aligning positions, and then the registration roller pair 48 is stopped.

In other words, the registration roller pair 48 is rotated to be displaced a given amount toward a downstream side in the sheet conveying direction, and then the registration roller pair 48 is stopped.

Then, as shown in state C of FIG. 14, the registration roller pair 48 are rotated by the angle $\alpha$ in a reverse direction to the sheet conveying direction, and then the registration roller pair 48 is stopped.

By so doing, the backlash of the gear 56 in the sheet conveying direction becomes zero as shown in FIG. 15.

The angle $\alpha$ is an angle of degree in such a range as to be able to remove the backlash.

The backlash of the gear (e.g., the small gear 56) increases as the gear wears over time.

Although the registration roller pair 48 is rotated by a rotation angle in the reverse direction is the angle $\alpha$ in this example, the rotation angle in the reverse direction may be degrees $\alpha$ plus a correction amount $\beta$ according to change of conditions over time such as a driven time and the number of conveyed sheets of paper.

By so doing, the backlash in the sheet conveying direction can be constantly maintained to zero.

The correction amount $\beta$ is obtained in advance based on results of experiments, stored in memory of the controller 80, and adjusted by using the table control.

By so doing, even if the sheet (e.g., the sheet 20) is conveyed to abut against the contact surfaces 64*a*, rotation positions of the gate members 64 and the registration roller pair 48 do not vary and skew correction with high accuracy can be performed.

Next, a description is given of a different configuration of the sheet conveying device 26 according to yet another example with reference to FIGS. 16 to 18C.

Figure 16:
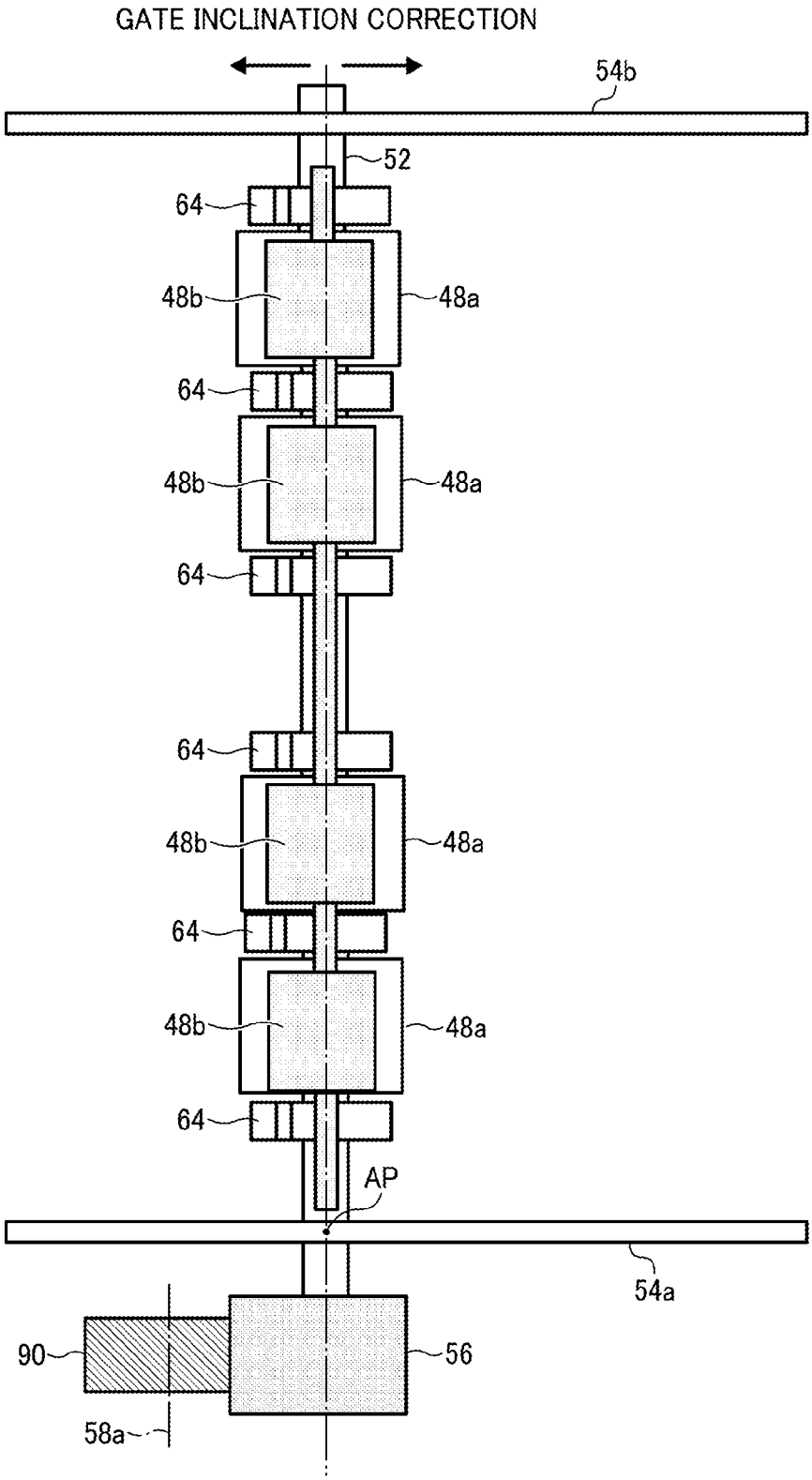
FIG. 16 is a plan view illustrating a configuration of gate inclination correction of a gate member according to yet another example of the disclosure.
Figure 17A:
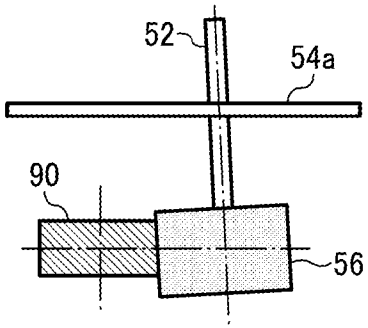
FIGS. 17A through 17C are plan views illustrating respective gear meshing when a rotary shaft is inclined.
Figure 17B:
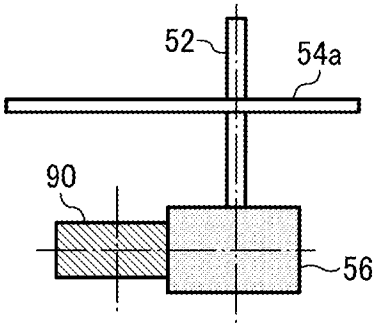
Figure 17C:
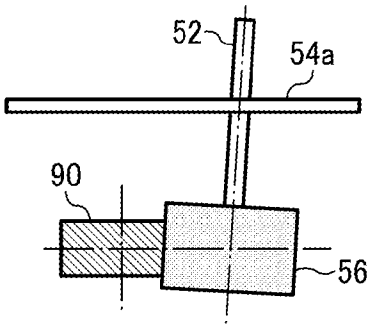
Figure 18A:
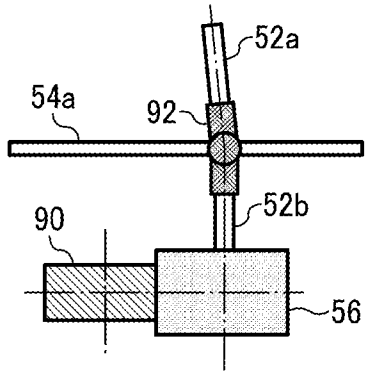
FIGS. 18A through 18C are plan views illustrating respective gear meshing when rotary shafts are connected by a constant velocity universal joint and inclined.
Figure 18B:
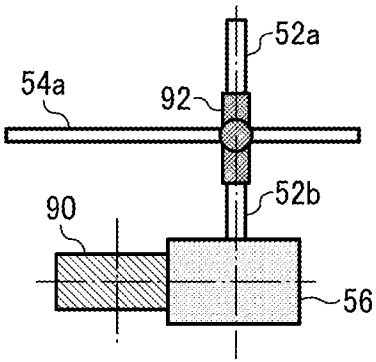
Figure 18C:
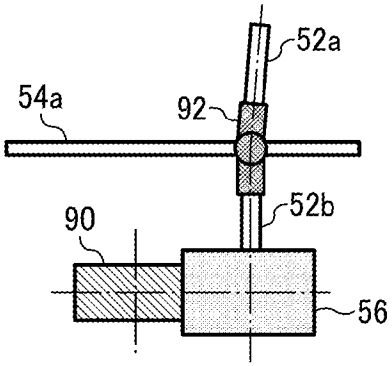

FIG. 16 is a plan view illustrating a configuration of gate inclination correction of the gate members 64. FIGS. 17A through 17C are plan views illustrating respective gear meshing when the rotary shaft 52 is inclined. FIGS. 18A through 18C are plan views illustrating respective gear meshing when rotary shafts are connected by a constant velocity universal joint and inclined.

As illustrated in FIGS. 17A to 17C, the example has a structure for adjusting a diagonal displacement correction amount by displacing an opposite side of the rotary shaft 52 from a drive force transmitting side forward and backward in the sheet conveying direction with respect to the side plate 54*b*. Specifically, FIG. 17A illustrates a state in which the rotary shaft 52 is inclined to the left. FIG. 17B illustrates a state in which the rotary shaft 52 is not inclined. FIG. 17C illustrates a state in which the rotary shaft 52 is inclined to the right.

Specifically, by using the drive force transmitting side of the rotary shaft 52 as a fulcrum (a supporting point) AP, inclination can be given to a line connecting respective contact surfaces 64*a* arranged in the sheet width direction orthogonal to the sheet conveying direction.

By so doing, the gate members 64 can adjust the diagonal displacement correction amount (skew correction amount).

Further, when the contact surfaces 64*a*, which are the faces for skew correction by the respective gate members 64, is not arranged in parallel to the sheet width direction orthogonal to the sheet conveying direction, the gate members 64 can adjust the arrangement of the contact surfaces 64*a*.

In this example, as compared with the structure in FIG. 3, the number of drive roller 48*a* and the number of driven rollers 48*b* are increased.

Furthermore, a gear 90 that functions as a driving gear attached to a rotary shaft 58*a* of the stepping motor 58 is meshed with the small gear 56 as a driven gear attached to an end (on a fulcrum side) of the rotary shaft 52 to transmit the driving force.

In this structure, if the rotary shaft 52 is displaced so as to adjust the skew correction amount on the side of the side plate 54*b*, the rotary shaft 52 as a driven shaft is inclined also on a side of the gear 56, and therefore proper gear meshing of the gear 56 with the gear 90 can be maintained.

Specifically, as illustrated in FIGS. 17A and 17C, if the rotary shaft 52 is inclined in a left-right direction, the gear meshing between the small gear 56 and the gear 90 is impaired.

Rotation of the small gear 56 and the gear 90 with improper gear meshing thereof may cause a mechanical failure.

Therefore, in the present example, as illustrated in FIGS. 18A to 18C, the rotary shaft 52 has a divided structure in which the rotary shaft 52 is divided into a skew correcting roller shaft 52*a* for supporting the drive roller 48*a* and a driven shaft 52*b* for supporting the gear 56 and the skew correcting roller shaft 52*a* and the driven shaft 52*b* are connected by a constant velocity universal joint 92 as a joint member (not shown in FIG. 16). Specifically, FIG. 18A illustrates a state in which the skew correcting roller shaft 52*a* is inclined to the left. FIG. 18B illustrates a state in which the skew correcting roller shaft 52*a* is not inclined. FIG. 18C illustrates a state in which the skew correcting roller shaft 52*a* is inclined to the right.

By so doing, even if the skew correcting roller shaft 52*a* is inclined to adjust the skew correction amount, as illustrated in FIGS. 18A and 18C, the driven shaft 52*b* is not inclined and proper gear meshing between the gear 90 that functions as the driving gear and the gear 56 that functions as the driven gear can be maintained.

Specifically, a portion provided with the driven gear is not displaced at the time of adjustment of the diagonal displacement correction amount by the gate members 64.

Even if there is an angle between the skew correcting roller shaft 52*a* and the driven shaft 52*b*, the constant velocity universal joint 92 can transmit rotation at a constant velocity.

In the present example, if a driving gear side is formed as a gear train formed by a plurality of gears including the small gear 56, the large gear 60, and the multi-stage gear 62 as illustrated in FIG. 3, the driving gear is a gear on an extremely downstream side.

As the joint member, different universal joints may be used.

In a conventional method, a side reference face is disposed parallel to a sheet conveying direction and a skew roller, an angle of which can be changed by a motor, skew-feeds paper to the side reference face to correct a skew.

This method includes the motor for changing the angle of the skew roller, and therefore an increase in size of an apparatus is unavoidable. However, in the present example, the gears are simply connected by the joint member as described above, which prevents the increase in size of the apparatus.

Although the conveying roller pair 50 is disposed on the downstream side of the registration roller pair 48 in each of the above-described examples, an image transfer part (the secondary transfer part) may be disposed immediately downstream from the registration roller pair 48.

Although the tandem intermediate transfer method is used in the image forming apparatus (e.g., the image forming apparatus 10) in each of the above-described examples, this disclosure is not limited thereto. This disclosure can be similarly carried out in a tandem direct transfer method, a single-drum multicolor method, or a black and white apparatus.

Although the preferred examples of the invention have been described, the invention is not limited to the specific examples and can be modified and changed in various ways without departing from the gist of the invention described in claims unless otherwise limited in the above description.

Effects described in the examples of the invention are merely examples of the best preferable effects exerted by the invention and the effects of the invention are not limited to those described in the examples of the invention.

The above-described examples and embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the examples and embodiments, such as the number, the position, and the shape are not limited the examples and embodiments and thus may be preferably set. It is therefore to be understood that within the scope of the appended claims, the disclosure of this disclosure may be practiced otherwise than as specifically described herein.

What is claimed is:

1. A sheet conveying device, comprising:

a sheet holding and conveying roller pair having two rollers to convey a sheet while holding the sheet between the two rollers at a nip where the two rollers contact each other;

a gate member disposed in a vicinity of the sheet holding and conveying roller pair and movable with rotation of the sheet holding and conveying roller pair to correct skew of the sheet in a sheet conveying direction when a leading end of the sheet in the sheet conveying direction abuts against the gate member, wherein the gate member has a contact surface against which the sheet abuts, wherein the contact surface of the gate member is disposed upstream from the nip of the sheet holding and conveying roller pair in the sheet conveying direction, wherein a setting position of the contact surface is adjusted according to thickness of the sheet, wherein the setting position of the contact surface of the gate member in conveyance of a thick paper is farther from the nip than the setting position of the contact surface of the gate member in conveyance of a thin paper;

a sheet thickness setting unit to set a thickness of the sheet; and a controller to adjust the setting position of the contact surface according to the thickness of the sheet set by the sheet thickness setting unit.

2. The sheet conveying device according to claim 1, further comprising a drive source to apply a driving force to the sheet holding and conveying roller pair and a gear train to transmit the driving force from the drive source, wherein, when the sheet at post skew correction is conveyed by rotating the sheet holding and conveying roller pair to position the contact surface at the setting position to perform subsequent skew correction, the sheet holding and conveying roller pair is rotated to shift the contact surface for a given amount to a downstream side from the setting position in the sheet conveying direction and then is rotated in reverse.

3. The sheet conveying device according to claim 2, wherein the given amount of shift of the contact surface is adjusted according to one of a driving time and a sheet conveying number.

4. The sheet conveying device according to claim 1, further comprising a shift mechanism to shift a position of the sheet in a sheet width direction perpendicular to the sheet conveying direction.

5. The sheet conveying device according to claim 4, further comprising a sheet position detector to detect a position of the sheet in the sheet width direction, wherein an amount of shift is determined based on a detection result obtained by the sheet position detector.

6. An image forming apparatus comprising:

an image carrier on which an electrostatic latent image is formed based on image data;

a developing device to develop the electrostatic latent image formed on the image carrier into a visible toner image;

the sheet conveying device according to claim 1 to transfer the visible toner image developed in the developing device onto the sheet; and a fixing device to fix the visible toner image conveyed by the sheet conveying device to the sheet.

7. A sheet conveying device, comprising:

a sheet holding and conveying roller pair having two rollers to convey a sheet while holding the sheet between the two rollers at a nip where the two rollers contact each other;

a gate member disposed in a vicinity of the sheet holding and conveying roller pair and movable with rotation of the sheet holding and conveying roller pair to correct skew of the sheet in a sheet conveying direction when a leading end of the sheet in the sheet conveying direction abuts against the gate member, wherein the gate member has a contact surface against which the sheet abuts, wherein the contact surface of the gate member is disposed upstream from the nip of the sheet holding and conveying roller pair in the sheet conveying direction, wherein a setting position of the contact surface is adjusted according to thickness of the sheet, wherein the setting position of the contact surface of the gate member in conveyance of a thick paper is farther from the nip than the setting position of the contact surface of the gate member in conveyance of a thin paper;

a sheet thickness detector to detect a thickness of the sheet; and a controller to adjust the setting position of the contact surface according to the thickness of the sheet detected by the sheet thickness detector.

8. A sheet conveying device, comprising:

a sheet holding and conveying roller pair having two rollers to convey a sheet while holding the sheet between the two rollers at a nip where the two rollers contact each other;

a gate member disposed in a vicinity of the sheet holding and conveying roller pair and movable with rotation of the sheet holding and conveying roller pair to correct skew of the sheet in a sheet conveying direction when a leading end of the sheet in the sheet conveying direction abuts against the gate member, wherein the gate member has a contact surface against which the sheet abuts, wherein the contact surface of the gate member is disposed upstream from the nip of the sheet holding and conveying roller pair in the sheet conveying direction, wherein a setting position of the contact surface is adjusted according to thickness of the sheet;

a drive source to apply a driving force to the sheet holding and conveying roller pair;

a first side plate disposed at a driving force transmitting side;

a second side plate disposed facing the first side plate at an opposite side to the driving force transmitting side;

a driving gear connected to the drive source; and a driven gear that meshes with the driving gear and is attached to a rotary shaft at the driving force transmitting side, wherein the sheet holding and conveying roller pair includes a first roller to which the driving force is transmitted from the drive source and a second roller that contacts the first roller when conveying the sheet, the first roller having the rotary shaft at the driving force transmitting side, wherein the gate member is attached to the rotary shaft of the first roller, wherein the rotary shaft of the first roller is rotatably supported between the first side plate and the second side plate, wherein the rotary shaft of the first roller at the driving force transmitting side has a supporting point and the second side plate at the opposite side is displaced in the sheet conveying direction with respect to the supporting point, wherein the rotary shaft at the driving force transmitting side has a divided structure connected by a joint member.

9. The sheet conveying device according to claim 8, wherein, in the divided structure, the rotary shaft of the first roller includes a skew correcting roller shaft to support the first roller and a driven shaft to support the driven gear, wherein the skew correcting roller shaft and the driven shaft are connected by the joint member, wherein, even if the skew correcting roller shaft is inclined to adjust a correction amount of skew of the sheet in the sheet conveying direction, the driven shaft is not inclined and proper gear meshing between the driving gear and the driven gear is maintained.

10. The sheet conveying device according to claim 8, wherein the joint member is a constant velocity universal joint.

* * * * *